US005685237A

United States Patent [19]

Lehrman

[11] Patent Number: 5,685,237

[45] Date of Patent: Nov. 11, 1997

[54] EXTENDABLE SUPPORT FOOT FOR AN IRONING BOARD

[75] Inventor: David Lehrman, 207 Barclay Cir., Cheltenham, Pa. 19012

[73] Assignee: David Lehrman, Philadelphia, Pa.

[21] Appl. No.: 586,050

[22] Filed: Jan. 16, 1996

[51] Int. Cl.[6] ..... A47B 3/02

[52] U.S. Cl. ..... 108/118; 248/188.5; 248/188.8

[58] Field of Search ..... 108/118, 117; 248/188.8, 188.5, 200.1, 188.7, 188.9, 616; 38/DIG. 1, DIG. 2, DIG. 3

[56] References Cited

U.S. PATENT DOCUMENTS

| | | | |
|---|---|---|---|
| 2,165,426 | 7/1939 | Tuttle et al. | 248/188.5 |
| 2,473,351 | 6/1949 | Thompson et al. | 248/188.5 |
| 2,661,554 | 12/1953 | Siczkiewicz | 108/117 |
| 2,771,261 | 11/1956 | Niggeloh | 248/188.5 |
| 2,908,984 | 10/1959 | Lantz | 108/117 |
| 2,912,202 | 11/1959 | Petrick | 248/188.8 X |
| 3,268,194 | 8/1966 | Nielsen | 248/188.2 |
| 3,338,539 | 8/1967 | Foster | 248/188.2 |
| 3,855,946 | 12/1974 | Bales | 248/188.5 X |
| 4,970,968 | 11/1990 | Mattesky | 248/188.5 X |
| 5,281,063 | 1/1994 | Austin, III | 248/200.1 X |

FOREIGN PATENT DOCUMENTS

| | | | |
|---|---|---|---|
| 930073 | 2/1948 | France | 248/200.1 |
| 1213226 | 1/1959 | France . | |
| 1 801 159 | of 1970 | Germany . | |

*Primary Examiner*—Peter M. Cuomo
*Assistant Examiner*—Janet M. Wilkens
*Attorney, Agent, or Firm*—Seidel, Gonda, Lavorgna & Monaco

[57] ABSTRACT

An extendable support foot for an ironing board is disclosed. The ironing board includes an ironing table with at least one support leg extending therefrom. The support foot includes an outer tubular member attached to the support leg and an inner tubular member disposed within the outer tubular member. A guide is attached to the outer tubular member and has a bearing portion disposed between the outer tubular member and the inner tubular member. The bearing portion includes an inner race diameter which is slightly larger than the outer diameter of the inner tubular member so as to permit sliding and rotation of the inner tubular member within the guide and with respect to the outer tubular member. A rotatably engagable locking mechanism is located between the inner tubular member and the outer tubular member. The locking mechanism has an unlocked position for allowing sliding of the inner tubular member with respect to the outer tubular member, and a locked position for preventing sliding of the inner tubular member with respect to the outer tubular member. In one embodiment, the locking mechanism includes a fixed locking element attached to the inner tubular member and a rotatable locking element disposed about the fixed locking element. The rotatable locking element is in frictional contact with an inner surface of the outer tubular member when the locking mechanism is in its locked position.

14 Claims, 2 Drawing Sheets

EXTENDABLE SUPPORT FOOT FOR AN IRONING BOARD

FIELD OF THE INVENTION

The present invention is related to ironing boards and, more particularly, an improved extendable support foot for an ironing board which provides increased lateral stability and is retractable for compact storage.

BACKGROUND OF THE INVENTION

Conventional ironing boards include an ironing table with support legs attached thereto. The support legs are typically attached via a pivotal attachment permitting the ironing board to be folded between an open position (wherein the legs are fully extended from the table) and a closed position (wherein the legs are retracted so as to lie against the table). The support legs may also include support feet which are designed to lie flat against a floor when the ironing board is in its open position. The support feet are designed to provide stability for the ironing board during use.

The degree of stability provided by the support feet is limited by the width of the support feet. That is, the amount of stability of the ironing board table is a function of the width of the support feet. Conventional designs utilize support feet which are only as wide as the table so as to provide a relatively small envelope for convenient storage. Accordingly, these table designs only provide a minimal amount of lateral support. While wider support feet would provide increased stability, such a design would make storage of the ironing board relatively difficult.

In order to provide additional support and stability for the ironing table, some prior art designs have incorporated complex extendable support feet. One such design is shown in U.S. Pat. No. 4,970,968. In this design the extendable support foot includes an outer tubular member and an inner tubular member. The inner tubular member rides within an inner sleeve which is locked into the outer tubular member by a bent-in flange. The inner tubular member is restrained within the outer tubular member by an outwardly bent flange formed on the inner tubular member. A cap portion is attached to the inner tubular member and extends therewith. The cap portion is designed to rest against the floor in either position of the inner tubular member. This prior art design is very complex and expensive to manufacture and also does not provide any locking features for locking the inner tubular member in its extended position. Accordingly, during use the inner tubular member of the support foot could potentially move from its extended position to a retracted position thereby reducing the stability of the board.

A need therefore exists for an ironing board with an extendable foot which provides increased stability and is lockable in extended and retracted positions.

SUMMARY OF THE INVENTION

The present invention is directed to an extendable support foot for an ironing board. The ironing board includes an ironing table with at least one support leg extending therefrom. The support foot includes an outer tubular member attached to the support leg and an inner tubular member disposed within the outer tubular member. A guide is attached to the outer tubular member and has a bearing portion disposed between the outer tubular member and the inner tubular member. The bearing portion includes an inner race diameter which is slightly larger than the outer diameter of the inner tubular member so as to permit sliding and rotation of the inner tubular member within the guide and with respect to the outer tubular member.

A rotatably engagable locking mechanism is located between the inner tubular member and the outer tubular member. The locking mechanism has an unlocked position for allowing sliding of the inner tubular member with respect to the outer tubular member, and a locked position for preventing sliding of the inner tubular member with respect to the outer tubular member. In one embodiment, the locking mechanism includes a fixed locking element attached to the inner tubular member and a rotatable locking element disposed about the fixed locking element. In the unlocked position, the rotatable and fixed locking elements define a shape having a geometric center which is substantially coaxial with an axis of rotation of the inner tubular member. In the locked position, the rotatable and fixed locking elements define a shape having a geometric center which is eccentric from an axis of rotation of the inner tubular member. Furthermore, the rotatable locking element is in frictional contact with an inner surface of the outer tubular member when the locking mechanism is in its locked position.

The foregoing and other features and advantages of the present invention will become more apparent in light of the following detailed description of the preferred embodiments thereof, as illustrated in the accompanying figures.

BRIEF DESCRIPTION OF THE DRAWINGS

For the purpose of illustrating the invention, the drawings show a form of the invention which is presently preferred. However, it should be understood that this invention is not limited to the precise arrangements and the present this invention is not limited to the precise arrangements and instrumentalities shown in the drawings.

DESCRIPTION OF THE PREFERRED EMBODIMENTS

Figure 1:
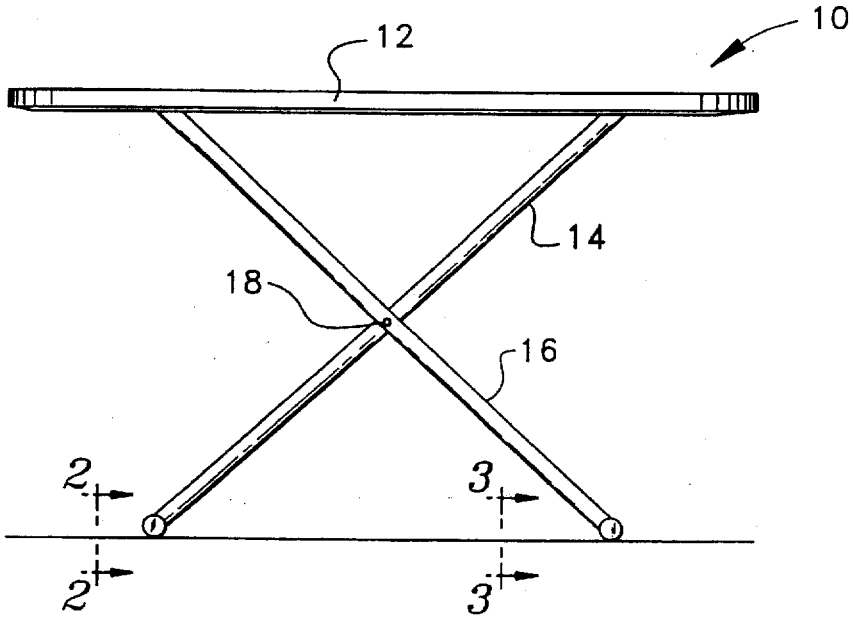
FIG. 1 is a side view of an ironing board which incorporates the present invention.

Referring now to the drawings wherein like reference numerals illustrate corresponding or similar elements throughout the several views, FIG. 1 illustrates the foldable ironing board 10 of the present invention in its open, operative position. The ironing board 10 is capable of being folded to a collapsed or storage position (not shown) for convenience in storage. The ironing board 10 has a normal ironing table 12 which includes a nose portion and a heel portion. The ironing table 12, furthermore, has a skeletal structure attached thereunder which provides support for the ironing table 12 during the ironing process. The configuration of the skeletal structure is not critical to the invention apart from the specific aspects thereof discussed below. The skeletal structure may be formed integral with the ironing table 12 or, alternately, may be separately attached thereto.

The ironing board 10 has forward and aft support legs 14, 16 which mount to and provide support for the ironing table 12 while in its raised, open position. The mounting of at least one of the forward and aft support legs 14, 16 to the underside of the ironing table 12 is, preferably, through a slidable attachment which permits the support leg to slide with respect to the ironing table 12, when the ironing board 10 is being folded. Those skilled in the field of ironing boards are well aware of the various attachment mechanisms that exist for mounting support legs to a folding ironing board and, therefore, no further discussion is needed.

The forward support leg 14 connects to the skeletal structure of the ironing table 12 and extends in a rearwardly direction. The aft support leg 16 connects to the skeletal structure of the ironing table 12 at a location aft of the forward support leg 14 attachment and extends in a forwardly direction.

The forward support leg 14 and the aft support leg 16 are pivotally attached to one another at a prescribed location 18 along their respective lengths. The pivotal attachment can be made by any suitable means, for example, pinning or bolting of the support legs 14, 16 to one another. When the ironing board 10 is folded to either its standing (open) or collapsed (storage) positions, the support legs 14, 16 pivot about point 18 causing the portions of the support legs 14, 16 above and below pivot point 18 to "scissor" with respect to each other. For example, when the ironing board 10 is folded from its open, operative position shown in FIG. 1 to a collapsed position, the forward and aft support legs 14, 16 pivot about point 18 causing their respective upper ends to move apart from one another. The lower ends of the support legs 14, 16 function in an identical fashion, i.e., the ends move apart during folding to a collapsed position.

The support legs 14, 16, skeletal structure and ironing table 12 are each, preferably, made from metallic material, such as aluminum or steel, so as to provide a stable and strong ironing board 10 upon which to iron. Plastic material may also be utilized to make some or all of the components if a lightweight design is desired.

Figure 2:
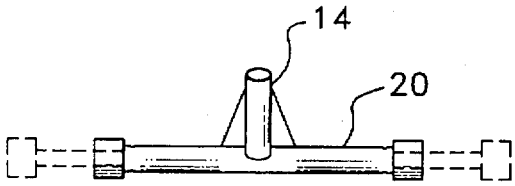
FIG. 2 is a partial rear view of the forward extendable foot according to the present invention.
Figure 3:
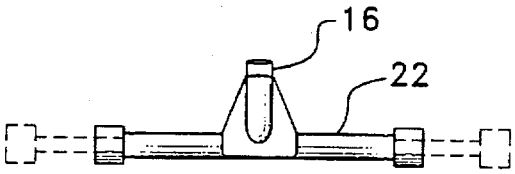
FIG. 3 is a partial rear view of the rear extendable foot according to the present invention.

Referring to FIG. 2, the forward support leg 14 has a foot 20 attached to a distal end. The foot 20 is preferably attached at right angles to the support leg so as to form what is known as a T-shaped leg. The foot 20 is designed to extend substantially horizontal to the floor when the ironing board 10 is in its open position and functions to provide lateral support for the ironing board 10 during use. The foot 20 is extendable between a retracted position (shown as solid lines) and an extended position (shown as phantom lines) as will be discussed in more detail hereinbelow. The foot 20 can be attached by any suitable means (e.g., welded, riveted, threaded). FIG. 3 shows an optional extendable foot 22 attached to the aft support leg 16 and is identical to the foot 20 in FIG. 2. For the sake of brevity, only the extendable foot in FIG. 2 will be discussed. Those skilled in the art will understand that the following discussion is equally applicable to the extendable foot 22 mounted on the aft support leg 16.

Figure 4:
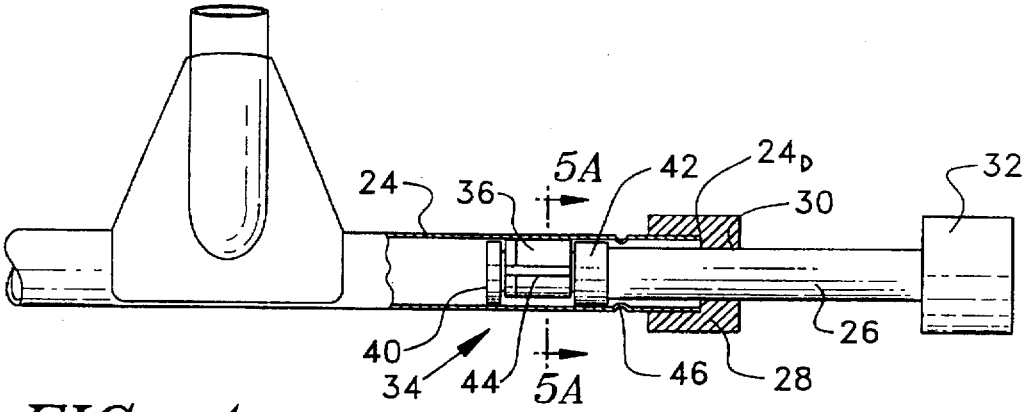
FIG. 4 is a partial section view of the extendable foot according to the present invention illustrating an internal locking mechanism.

FIG. 4 illustrates the structure of the extendable foot 20 in more detail. The foot 20 includes an outer tubular member 24 into which is slidably disposed an inner tubular member 26. The outer tubular member 24 preferably extends outward approximately the same distance on either side of the support leg 14, although variations in the length are acceptable. The outer tubular member 24 terminates at distal ends $24_D$. In order to slide within the outer tubular member 24, the outer diameter of the inner tubular member 26 is, logically, smaller than the inner diameter of the outer tubular member 24. In the preferred embodiment, the outer diameter of the inner tubular member 26 is approximately 0.75 inches and the inner diameter of the outer tubular member 24 is approximately 1.0 inches. Other dimensions can be substituted therefor without detracting from the invention. The inner tubular member 26 can be solid if desired.

The 0.25 inch difference between the diameters of the tubular members permits relatively uninhibited sliding of the inner tubular member 26 within the outer tubular member 24. This difference in diameters will, however, produce wobbling of the inner tubular member 26 within the outer tubular member 24. In order to prevent this wobbling, a bearing is formed between the two tubular members. More specifically, a guide 28 is preferably attached to the outer tubular member 24 and has bearing portion 30 with an inner race diameter which is slightly larger than the outer diameter of the inner tubular member 26 so as to permit the inner tubular member 26 to slide and rotate within the bearing portion 30 of the guide 28. The guide 28 is preferably made from a material having a relatively low coefficient of friction, such as plastic, so as not to inhibit the sliding motion of the inner tubular member 26. Alternately, the inner race surface of the bearing portion 30 or the outer surface of the inner tubular member 26 can have a low frictional surface disposed thereon, such as polytetrafluoroethylene which is commonly referred to as TEFLON®. (TEFLON is a registered trademark of du Pont de Nemours & Co., Inc., Wilmington, Del.) The guide 28 is preferably attached to the outer surface of the outer tubular member 24 by any suitable attachment means, such as by press-fit or adhesive.

Mounted on the distal end of each inner tubular member 26 is an end cap 32 which is designed to rest against the floor during ironing. The end cap 32 has a cylindrical shape with an outer diameter that is preferably larger than the outer diameter of the outer tubular member 24. The end cap 32 is attached to the inner tubular member 26 by any suitable attachment means, such as by press-fit or adhesive.

The guide 28 also preferably has a cylindrical shape with an outer diameter which is substantially the same as the diameter of the end cap 32. In one preferred embodiment the outer diameter of the end cap 32 and the guide 28 is approximately 1.25 inches. Accordingly, when the ironing board 10 is in its open, operative position, the end cap 32 on each inner tubular extension member 26 and the guide 28 on each outer tubular extension member 24 rest on the floor. This arrangement provides four contact points between the foot 20 and the floor, as opposed to two contact points in prior art support feet. The loads generated during ironing are efficiently distributed to the floor via these four contact points. Furthermore, since the guides 28 in the preferred embodiment are attached directly to the outer tubular member 24, a significant portion of the applied loads are transferred directly to the floor through the guides 28. The mount of load transferred along the inner tubular member 26 to the end cap is, therefore, reduced permitting the inner tubular member 26 to be made less rigid (e.g., smaller diameter, thinner wall section, or lighter material). This results in an overall lighter weight ironing board 10.

The foot 20 in the present invention also includes a locking mechanism 34 which operates to lock the foot in an extended or retracted position. The locking mechanism 34 includes a rotatable locking element 36 rotatably mounted about a fixed locking element (identified by numeral 38 in FIG. 5A). As will become more apparent below, the term "fixed" is intended to mean fixed with respect to the inner tubular member 26. The rotatable locking element 36 is retained on the fixed locking element 38 by a retention flange 40 formed on the inboard side of the fixed locking element 38 and a shoulder 42 formed on the outboard side of the fixed locking element 38. In the illustrated embodiment, the fixed locking element 38, retention flange 40 and shoulder 42 are formed integral with one another. The rotatable locking element 36 has a notch 44 cut through one side for allowing the rotatable locking element 36 to slip laterally onto the fixed locking element 38. Alternately, the retention flange 40 can be removable (e.g., threadingly engaged with the fixed locking element) permitting a contiguous rotatable locking element 36 to be utilized. Those skilled in the art would understand that a variety of other locking mechanisms can be substituted for the above embodiment.

The locking mechanism 34 is attached to the inner tubular member 26 by a crimp. Other methods for attaching the locking mechanism 34 can be substituted for the crimp and are well within the scope of the claims. For example, the inner tubular member 26, fixed locking element 38, retention flange 40 and shoulder 42 can all be formed as a single unit.

Figure 5A:
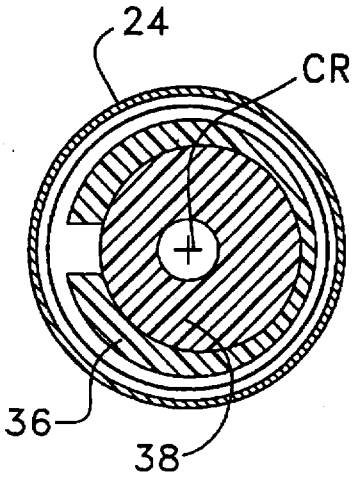
FIG. 5A is a section view of the extendable foot taken along line 5A—5A in FIG. 4 and showing the internal locking mechanism in its unlocked position.

The operation of the locking mechanism 34 will now be discussed with reference to FIGS. 5A and 5B. FIG. 5A illustrates the unlocked position of the locking mechanism 34. In this position, the combination of the rotatable locking element 36 and the fixed locking element 38 (i.e., the locking mechanism) define a substantially cylindrical shape having a geometric center which is approximately coaxial with the center of rotation (CR) of the inner tubular member 26. And, since the inner tubular member 26 is substantially concentric with the inner surface or wall of the outer tubular member 24, the shape formed by the locking mechanism 34 is likewise substantially concentric with the inner surface of the outer tubular member 24. The diameter of the shape formed by the locking mechanism 34 is less than the inner diameter of the outer tubular member 24 so as to permit relatively unrestricted motion of the locking mechanism 34 within the outer tubular member 24.

Figure 5B:
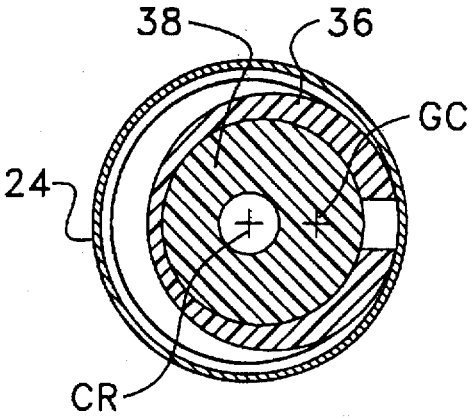
FIG. 5B is a section view of the extendable foot showing the internal locking mechanism in its locked position.

FIG. 5B shows the locked position of the locking mechanism. In this position, the combination of the rotatable locking element 36 and the fixed locking element 38 define a shape having a geometric center (GC) which is eccentric from the center of rotation (CR) of the inner tubular member 26. The eccentricity of the combination of the rotatable locking element 36 and the fixed locking element 38 is such that the rotatable locking element 36 is in frictional contact with the inner surface or wall of the outer tubular member 24. The frictional contact between the locking mechanism 34 and the outer tubular member 24 locks the inner tubular member 26 to the outer tubular member 24 so as to prevent the inner tubular member 26 from sliding with respect to the outer tubular member 24. When it is in its locked position, the locking mechanism 34 provides support between the inner tubular member 26 and the outer tubular member 24 in addition to the guide 28.

In order to move the locking mechanism 34 between the locked and unlocked positions (i.e., to vary the amount of eccentricity), the fixed locking element 38 has a geometric center which is eccentric to the axis of rotation of the inner tubular member 26. The rotatable locking element 36 is tubular in shape with an inner diameter that is preferably eccentric to its outer diameter (i.e., non-concentric wall thickness) as shown in the figures. Accordingly, when the rotatable locking element 36 is rotated with respect to the fixed locking element 38 a change will occur in the overall eccentricity of the locking mechanism 34. That is, rotation of the rotatable locking element 36 alters the geometric center of the locking mechanism. Since the inner surface of the outer tubular member 24 is fixed with respect to the locking mechanism 34, rotation of the rotatable locking element 36 will cause the locking mechanism 34 to frictionally engage and disengage with the outer tubular member 24.

As discussed above, rotatable and fixed locking elements 36, 38 are preferably configured so as to define a combined shape which, in one position, is substantially concentric with the outer tubular member 24. The components of the locking mechanism are preferably made from a lightweight material such as plastic, although other materials are also acceptable.

Figure 6A:
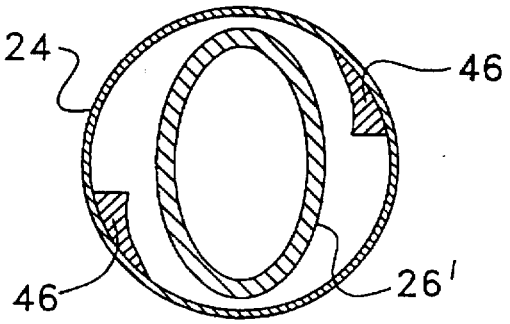
FIG. 6A is a section view of the extendable foot showing an alternate embodiment of the internal locking mechanism in its unlocked position.
Figure 6B:
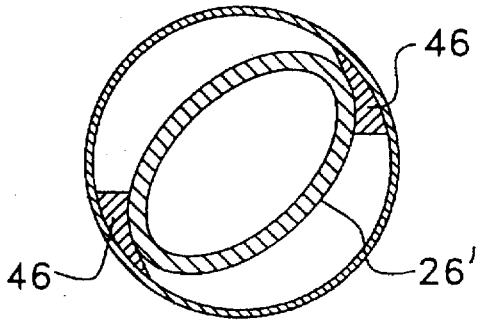
FIG. 6B is a section view of the extendable foot showing the alternate embodiment of the internal locking mechanism in its locked position.

Those skilled in the art readily appreciate the diverse locking mechanisms that can be utilized for locking the inner tubular member to the outer tubular member. For example, in one alternate embodiment shown in FIGS. 6A and 6B, the inner tubular member 26' is elliptically shaped. Locking pads 46 are mounted on the inner surface of the outer tubular member 24. The locking pads 46 are preferably wedge shaped and made from a resilient material such as rubber. Rotation of the inner tubular member 26' with respect to the outer tubular member 24 causes the elliptical outer surface of the inner tubular member 26' to frictionally engage with the locking pads 46, thereby locking the inner tubular member 26' so as to prevent sliding with respect to the outer tubular member 24.

Referring back to FIG. 4, in order to limit the extension of the inner tubular member 26 with respect to the outer tubular member 24, an indetentation, projection or crimp 46 is formed in the outer tubular member 24 at an outboard location and extends substantially radially inward toward the inner tubular member 26. The crimp 46 prevents the locking mechanism 34, located inboard from the crimp 46, from passing outward from the interior of the outer tubular member 24. Thus, the inner tubular member 26 is prevented from sliding completely out of the outer tubular member 24.

The operation of the ironing board 10 is as follows. The ironing board is raised to its operative position by scissoring the support legs. The user then extends the inner tubular member 26 on each foot by initially rotating the inner tubular member 26 in a first direction so as to unlock the locking mechanism 34. The inner tubular member 26 is then extended laterally outward a desired distance. The inner tubular member 26 is locked into the desired position by rotating it in an opposite direction from the first direction. Closing of the ironing board is accomplished by performing the above steps in reverse.

The above disclosed invention provides a novel support foot for an ironing board which increases the ironing board's overall stability while minimizing its storage envelope. In one embodiment, the extendable foot has a retracted width of approximately 15 inches and an extended width of approximately 20.5 inches. This provides about a 33% increase in footing. The present invention also provides a novel locking mechanism for maintaining the foot in its extended position.

Although the invention has been described and illustrated with respect to the exemplary embodiments thereof, it should be understood by those skilled in the art that the foregoing and various other changes, omissions and additions may be made therein and thereto, without departing from the spirit and scope of the present invention.

I claim:

1. An extendable support foot on an ironing board, the ironing board including an ironing table with at least one support leg extending therefrom, the support foot comprising:

an outer tubular member attached to the support leg;

an inner tubular member disposed within the outer tubular member;

a guide attached to the outer tubular member and having a bearing portion located external to the outer tubular member, the bearing portion for guiding the inner tubular member and having an inner race diameter which is slightly larger than an outer diameter of the inner tubular member so as to permit sliding and rotation of the inner tubular member within the guide and with respect to the outer tubular member;

a rotatably engagable locking mechanism located between the inner tubular member and the outer tubular member having an unlocked position for allowing sliding of the inner tubular member with respect to the outer tubular member, and a locked position for preventing sliding of the inner tubular member with respect to the outer tubular member; and holding means formed on the outer tubular member at a location inboard from an end of the outer tubular member, the holding means for preventing the inner tubular member from sliding out of the outer tubular member and for preventing the locking mechanism from contacting the guide.

2. An extendable support foot according to claim 1 further comprising an end cap attached to a distal end of the inner tubular member.

3. An extendable support foot according to claim 1 wherein the locking mechanism includes a fixed locking element attached to the inner tubular member and a rotatable locking element disposed about the fixed locking element.

4. An extendable support foot according to claim 3 wherein the rotatable and fixed locking elements define a shape having a geometric center which is substantially coaxial with an axis of rotation of the inner tubular member when the locking mechanism is in its unlocked position.

5. An extendable support foot according to claim 3 wherein the rotatable and fixed locking elements define a shape having a geometric center which is eccentric from an axis of rotation of the inner tubular member when the locking mechanism is in its locked position, and wherein the rotatable locking element is in frictional contact with an inner surface of the outer tubular member when the locking mechanism is in its locked position.

6. An extendable support foot according to claim 3 wherein rotation of the rotatable locking element with respect to the fixed locking element causes the locking mechanism to frictionally engage and disengage with an inner surface on the outer tubular member.

7. An extendable support foot according to claim 6 wherein the fixed locking mechanism has a geometric center which is eccentric to an axis of rotation of the inner tubular member, and the rotatable locking element has a tubular shape with an inner diameter that is eccentric to its outer diameter.

8. An extendable support foot according to claim 3 further comprising a retention flange for retaining the rotatable locking element about the fixed locking element.

9. An extendable support foot according to claim 1 wherein the holding means is a crimp formed in the outer tubular member.

10. An extendable support foot according to claim 1 wherein the guide is attached to the outer surface of the outer tubular member.

11. An extendable support foot according to claim 10 further comprising an end cap attached to a distal end of the inner tubular member, and wherein the guide has an outer diameter which is substantially the same as an outer diameter of the end cap.

12. An extendable support foot on an ironing board, the ironing board including an ironing table with at least one support leg extending therefrom, the support foot comprising:

an outer tubular member attached to the support leg;

an inner tubular member disposed within the outer tubular member;

a guide attached to the outer tubular member and having a bearing portion disposed between the outer tubular member and the inner tubular member, the bearing portion having an inner race diameter which is slightly larger than an outer diameter of the inner tubular member so as to permit sliding and rotation of the inner tubular member within the guide and with respect to the outer tubular member; and a rotatably engagable locking mechanism located between the inner tubular member and the outer tubular member having an unlocked position for allowing sliding of the inner tubular member with respect to the outer tubular member, and a locked position for preventing sliding of the inner tubular member with respect to the outer tubular member wherein the locking mechanism includes an elliptical portion of the inner tubular member and at least one locking pad mounted on the inner surface of the outer tubular member, and wherein frictional engagement between the elliptical inner tubular member and the at least one locking pad prevents the inner tubular member from sliding with respect to the outer tubular member.

13. An extendable support foot according to claim 12 wherein the guide is attached to the outer surface of the outer tubular member.

14. An extendable support foot according to claim 12 further comprising an end cap attached to a distal end of the inner tubular member, and wherein the guide has an outer diameter which is substantially the same as an outer diameter of the end cap.

* * * * *